US010707603B2

(12) United States Patent
Yufu et al.

(10) Patent No.: US 10,707,603 B2
(45) Date of Patent: Jul. 7, 2020

(54) ELECTRICAL CABLE CONNECTOR

(71) Applicant: DAI-ICHI SEIKO CO., LTD., Kyoto (JP)

(72) Inventors: Kenji Yufu, Tokyo (JP); Takao Yamauchi, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 16/402,892

(22) Filed: May 3, 2019

(65) Prior Publication Data

US 2019/0348784 A1 Nov. 14, 2019

(30) Foreign Application Priority Data

May 10, 2018 (JP) ..... 2018-091724

(51) Int. Cl.
*H01R 13/405* (2006.01)
*H01R 12/75* (2011.01)
*H01R 13/502* (2006.01)

(52) U.S. Cl.
CPC ..... *H01R 12/75* (2013.01); *H01R 13/405* (2013.01); *H01R 13/5025* (2013.01)

(58) Field of Classification Search
CPC ..... H01R 12/75; H01R 12/59; H01R 12/77; H01R 12/771; H01R 13/405; H01R 13/5025

(Continued)

(56) References Cited

U.S. PATENT DOCUMENTS 6,645,001 B2 * 11/2003 Okano ..... H01R 12/592 439/492
6,939,164 B2 * 9/2005 Noro ..... H01R 4/2429 439/492

(Continued)

FOREIGN PATENT DOCUMENTS

JP 2008146870 A 6/2008
JP 2010157368 A 7/2010

(Continued)

OTHER PUBLICATIONS

An Office Action; "Notification of Reasons for Refusal," mailed by the Japanese Patent Office on Feb. 12, 2020, which corresponds to Japanese Patent Application No. 2018-091724 and is related to U.S. Appl. No. 16/402,892 with English language translation.

*Primary Examiner* — Hien D Vu
(74) *Attorney, Agent, or Firm* — Studebaker & Brakcett PC

(57) ABSTRACT

An electrical cable connector comprising an insulating housing, a plurality of conductive contacts arranged on the insulating housing to be connected respectively with cables, and a resilient shell member attached to the insulating housing, wherein the resilient shell member includes a concealing portion for concealing a portion of the insulating housing on which the conductive contacts are arranged, a strip-shaped portion surrounding partially the insulating housing so as to cause an inner surface portion thereof to come into resilient contact with an outer surface portion of a mating connecting device, a pair of extended strip-shaped portions each extending to be bent from one of end portions of the strip-shaped portion so as to have a free end portion, and a pair of holding portions extending from the concealing portion for positioning respectively the extended strip-shaped portions from the outside thereof.

6 Claims, 9 Drawing Sheets

(58) Field of Classification Search
USPC ..... 439/78, 492, 499
See application file for complete search history.

(56) References Cited

U.S. PATENT DOCUMENTS

| | | | | |
|---|---|---|---|---|
| 7,914,322 | B2 * | 3/2011 | Lin | H01R 4/023 439/497 |
| 8,858,254 | B2 * | 10/2014 | Ikari | H01R 12/592 439/492 |
| 10,312,617 | B2 * | 6/2019 | Wang | H01R 12/77 |

FOREIGN PATENT DOCUMENTS

| | | | |
|---|---|---|---|
| JP | 2014143069 | A | 8/2014 |
| JP | 2015-230840 | A | 12/2015 |
| JP | 2016058270 | A | 4/2016 |
| JP | 2017027842 | A | 2/2017 |
| WO | 2016/178356 | A1 | 11/2016 |

* cited by examiner

ELECTRICAL CABLE CONNECTOR

BACKGROUND OF THE INVENTION

Field of the Invention

The present invention relates generally to an electrical cable connector, and more particularly to an improvement in an electrical cable connector, to which a plurality of cables, such as relatively thin coaxial cables, are connected, and which is used to be coupled with a mate electrical connector mounted on a circuit board for putting the cables connected thereto in electrical linkage with the circuit board.

Description of the Prior Art including Information Disclosed Under 37 CFR 1.97 and 37 CFR 1.98

When a plurality of cables, such as relatively thin coaxial cables, are put in electrical linkage with a circuit board on which various electrical parts are mounted, there have been often utilized an electrical cable connector constituting a plug connector, to which the cables are connected, and a mate electrical connector constituting a receptacle connector which is mounted on and connected electrically with the circuit board so as to be coupled with the plug connector. On that occasion, the plug connector is provided with a plurality of conductive contacts arranged on an insulating housing to be electrically connected respectively with the cables and the receptacle connector is provided with a plurality of mate conductive contacts arranged on a mate insulating housing to be electrically connected respectively with signal terminals provided on the circuit board.

Under a condition wherein the plug connector is coupled with the receptacle connector, the insulating housing of the plug connector is fitted to the mate insulating housing of the receptacle connector and thereby the conductive contacts of the plug connector are contact-connected respectively with the mate conductive contacts of the receptacle connector. As a result, the cables connected to the plug connector are electrically linked, through the conductive contacts of the plug connector and the mate conductive contacts of the receptacle connector, with the circuit board on which the receptacle connector is mounted.

It is required for the plug connector constituted with the electrical cable connector and the receptacle connector constituted with the mate electrical connector thus coupled with each other to maintain properly and stably a condition wherein the plug connector is coupled with the receptacle connector. Therefore, there have been previously proposed several retaining mechanisms each attending on at least one of the plug connector and the receptacle connector for retaining the plug connector in a condition of coupling with the receptacle connector, as disclosed in, for example, the PCT International Publication No. WO 2016/178356 A1 (hereinafter, referred to as a published prior art document).

A retaining mechanism disclosed in the published prior art document mentioned above attends on both of a plug connector (a multipolar connector (10)) and a receptacle connector (a mate connector (50)). The plug connector (the multipolar connector (10)) disclosed in the published prior art document comprises an insulating housing (an insulating member (16)), a plurality of conductive contacts (inner terminals (14*a* to 14*c*)) provided on the insulating housing and a resilient shell member (an external terminal (12)) made of metal plate material subjected to bending processing and fixed to the insulating housing so as to surround partially the same. Such a plug connector constituted as mentioned above is to be mounted on a first circuit board.

The resilient shell member of the plug connector thus proposed previously is provided with an outer frame portion (20) having a build portion (21) formed into a belt-like shape to be arranged around the insulating housing and a plurality of guiding portions (22*a* to 22*d*) provided respectively on corners of the build portion (21), a couple of bent portions (24*a*, 24*b*) provided on the build portion (21), and a plurality of connecting portions (26*a* to 26*c*) provided also on the build portion (21). The guiding portions (22*a* to 22*d*) are formed respectively into a plurality of protrusions (P1 to P4) each projecting toward the inside of the build portion (21).

When the plug connector is mounted on the first circuit board, the bent portions (24*a*, 24*b*) and the connecting portions (26*a* to 26*c*) provided on the build portion (21) of the outer frame portion (20) are connected to connecting land terminals provided on a parts-mounting surface of the first circuit board by means of soldering, so that the plug connector is fixed to the first circuit board. In the plug connector fixed to the first circuit board, the conductive contacts are connected respectively to separate connecting terminals provided on the parts-mounting surface of the first circuit board.

The plug connector mounted on the first circuit board in such a manner as mentioned above is caused to be coupled with the receptacle connector (the mate connector (50)) mounted on a second circuit board. The receptacle connector comprises a mate insulating housing (an insulating member (66)), a plurality of mate conductive contacts (inner terminals (64*a* to 64*c*)) provided on the mate insulating housing and a mate resilient shell member (an external terminal (52)) made of metal plate material subjected to bending processing and fixed to the mate insulating housing so as to surround partially the same. In the receptacle connector thus proposed, the mate resilient shell member is provided with a bottom portion (54) to be fixed on a parts-mounting surface of the second circuit board and an inner frame portion (56) formed into a belt-like shape to be arranged for surrounding the mate insulating housing so as to be connected with the plug connector mounted on the first circuit board. A plurality of recesses (Q1 to Q4) are provided respectively on corners of the inner frame portion (56) of the mate resilient shell member. Then, under a condition wherein the bottom portion (54) of the mate resilient shell member is fixed on the parts-mounting surface of the second circuit board so that the receptacle connector is fixed to the second circuit board, the mate conductive contacts are connected respectively to separate connecting terminals provided on the parts-mounting surface of the second circuit board.

When the plug connector mounted on the first circuit board is put in a condition of coupling with the receptacle connector mounted on the second circuit board, the build portion (21) of the outer frame portion (20) constituting the resilient shell member of the plug connector is put in resilient engagement with the inner frame portion (56) of the mate resilient shell member of the receptacle connector in such a manner that an inside surface of the build portion (21) is caused to come into contact with an outer surface of the inner frame portion (56). Under a condition wherein the build portion (21) of the outer frame portion (20) is resiliently engaged with the inner frame portion (56), the protrusions (P1 to P4) which are formed respectively with the guiding portions (22*a* to 22*d*) to be provided on the outer frame portion (20) so as to project toward the inside of the build portion (21), are put in engagement respectively with the recesses (Q1 to Q4) provided on the inner frame portion (56), so that the build portion (21) of the outer frame portion (20) is locked to the inner frame portion (56). This results in that it can be expected that the plug connector is stably maintained in engagement with the receptacle connector. Under such a condition, the outer frame portion (20) provided on the resilient shell member of the plug connector and the inner frame portion (56) provided on the mate resilient shell member of the receptacle connector are operative to constitute the retaining mechanism which retains the plug connector in the condition of engagement with the receptacle connector. Further, in the condition mentioned above, each of the conductive contacts provided on the insulating housing of the plug connector comes into contact with a corresponding one of the mate conductive contacts provided on the mate insulating housing of the receptacle connector, so that the first circuit board on which the plug connector is mounted is electrically linked through the plug connector and the receptacle connector with the second circuit board on which the receptacle connector is mounted.

In the plug connector (the multipolar connector (10)) to which the previously proposed retaining mechanism is applied as disclosed in the published prior art document mentioned above, there are the following defects or disadvantages.

It is usual that the plug connector mounted on the first circuit board is required to be subjected to effective reduction in thickness in a direction perpendicular to the parts-mounting surface of the first circuit board for achieving low-profile. Along with the reduction in thickness of the plug connector, the build portion (21) of the outer frame portion (20) is also reduced in a size in the direction perpendicular to the parts- mounting surface of the first circuit board (hereinafter, referred to as a vertical dimension).

Under such a situation, when the plug contact is put in coupling with the receptacle connector (the mate connector (50), the build portion (21) of the outer frame portion (20) provided on the resilient shell member of the plug connector is put in resilient engagement with the inner frame portion (56) provided on the mate resilient shell member of the receptacle connector in the manner that the inside surface of the build portion (21) is caused to come into contact with the outer surface of the inner frame portion (56) and the protrusions (P1 to P4) provided on the outer frame portion (20) to project toward the inside of the build portion (21) are put in engagement respectively with the recesses (Q1 to Q4) provided on the inner frame portion (56), so that that the plug connector is maintained in coupling with the receptacle connector. When the protrusions (P1 to P4) are caused to engage respectively with the recesses (Q1 to Q4), each of the protrusions (P1 to P4) gets over a peripheral portion of a corresponding one of the recesses (Q1 to Q4) so as to be put in the corresponding one of the recesses (Q1 to Q4). Therefore, when the build portion (21) of the outer frame portion (20) is caused to be resiliently engaged with the inner frame portion (56) of the mate resilient shell member of the mate electrical connector and accordingly each of the protrusions (P1 to P4) gets over the peripheral portion of the corresponding one of the recesses (Q1 to Q4) so as to be put in the corresponding one of the recesses (Q1 to Q4), the build portion (21) is once subjected to deformation caused by contact-pressure acting on each of the protrusions (P1 to P4) from the peripheral portion of the corresponding one of the recesses (Q1 to Q4) and then returns to the original with its own resilient restoring force. On that occasion, the reduction in the vertical dimension of the build portion (21) for achieving low-profile of the plug connector and changes with time in the vertical dimension of the build portion (21) exert a bad influence on mutual engagements between the protrusions (P1 to P4) and the recesses (Q1 to Q4).

In more detail, since the outer frame portion (20) having the build portion (21) and the guiding portions (22*a* to 22*d*) forming respectively the protrusions (P1 to P4) constitutes the resilient shell member of the plug connector and the resilient shell member is made of metal plate material subjected to bending processing, the build portion (21) of the outer frame portion (20) is also made of metal plate material subjected to bending processing. Therefore, it is hard for the build portion (21) of the outer frame portion (20) which is reduced in the vertical dimension for achieving low-profile of the plug connector to have sufficient resiliency and further the changes with time on the build portion (21) of the outer frame portion (20) bring about lowering in the resilient restoring force of the build portion (21), so that it is fared that the mutual engagement between the protrusions (P1 to P4) provided on the outer frame portion (20) and the protrusions (P1 to P4)provided on the inner frame portion (56) of the mate resilient shell member is deteriorated.

Under a condition wherein the build portion (21) of the outer frame portion (20) has insufficient resiliency and the resilient restoring force of the build portion (21) is lowered, any sufficient restored state of the build portion (21) is cannot to obtained when the build portion (21) is once subjected to deformation caused by contact-pressure acting on each of the protrusions (P1 to P4) from the peripheral portion of the corresponding one of the recesses (Q1 to Q4) and then returns to the original with its own resilient restoring force, so that it is difficult for the build portion (21) to cause each of the protrusions (P1 to P4) to engage properly and surely with the corresponding one of the protrusions (P1 to P4). This results in that the build portion (21) of the outer frame portion (20) provided on the resilient shell member is not able to be properly locked to the inner frame portion (56) of the mate resilient shell member and thereby the plug connector is not able to be properly and surely maintained in coupling with the receptacle connector.

BRIEF SUMMARY OF THE INVENTION

Accordingly, it is an object of the present invention to provide an electrical cable connector used with a plurality of cables, such as relatively thin coaxial cables, connected thereto, which is caused to be coupled with a mate electrical connector mounted on a circuit board for putting the cables connected thereto in electrical linkage with the circuit board and provided with a resilient shell member having an engaging portion for engaging resiliently with the mate electrical connector when the electrical cable connector is coupled with the mate electrical connector so as to maintaining the electrical cable connector in coupling with the mate electrical connector, and which avoids the aforementioned problems and disadvantages encountered with the prior art.

Another object of the present invention is to provide an electrical cable connector used with a plurality of cables, such as relatively thin coaxial cables, connected thereto, which is caused to be coupled with a mate electrical connector mounted on a circuit board for putting the cables connected thereto in electrical linkage with the circuit board and provided with a resilient shell member having an engaging portion for engaging resiliently with the mate electrical connector when the electrical cable connector is coupled with the mate electrical connector so as to maintaining the electrical cable connector in coupling with the mate electrical connector, and in which the resilient shell member is able to keep sufficient resiliency even under a situation wherein the electrical cable connector as a whole is subjected to reduction in its thickness for achieving low-profile, so that the electrical cable connector is maintained properly and surely in coupling with the mate electrical connector.

A further object of the present invention is to provide an electrical cable connector used with a plurality of cables, such as relatively thin coaxial cables, connected thereto, which is caused to be coupled with a mate electrical connector mounted on a circuit board for putting the cables connected thereto in electrical linkage with the circuit board and provided with a resilient shell member having an engaging portion for engaging resiliently with the mate electrical connector when the electrical cable connector is coupled with the mate electrical connector so as to maintaining the electrical cable connector in coupling with the mate electrical connector, and in which the resilient shell member is less susceptible to changes with time so as to be able to maintain properly and surely the electrical cable connector in coupling with the mate electrical connector.

According to the present invention, there is provided an electrical cable connector comprising an insulating housing provided to be fitted to a mate insulating housing of a mate electrical connector fixed to a parts-mounting surface of a circuit board, a plurality of conductive contacts arranged on the insulating housing, each of which is provided with a cable connecting portion to be connected with a cable and a contact-connecting portion operative to be put in contact with a corresponding one of mate conductive contacts arranged on the mate insulating housing of the mate electrical connector to be connected to the circuit board, and a resilient shell member attached to the insulating housing for engaging resiliently with the mate electrical connector when the electrical cable connector is coupled with the mate electrical connector, wherein the resilient shell member includes a concealing portion for concealing a portion of the insulating housing on which the conductive contacts are arranged, a strip-shaped portion linked with the concealing portion to surround partially the insulating housing for causing an inner surface portion thereof to come into resilient contact with an outer surface portion of the mate electrical connector, and a pair of extended strip-shaped portions each extending to be bent from one of end portions of the strip-shaped portion so as to have a free end portion, so that the strip-shaped portion and the extended strip-shaped portions constitute a spring member, and a pair of holding portions are provided in such a manner that each of the holding portions extends from the concealing portion for positioning the extended strip- shaped portion from the outside thereof.

In the electrical cable connector thus constituted in accordance with the present invention, the resilient shell member which is attached to the insulating housing for engaging resiliently with the mate electrical connector when the electrical cable connector is coupled with the mate electrical connector so as to maintaining the electrical cable connector in coupling with the mate electrical connector, comprises the concealing portion for covering the portion of the insulating housing on which the conductive contact are arranged, the strip-shaped portion linked with the concealing portion to extend around the insulating housing for causing the inner surface portion thereof to come into resilient contact with the outer surface portion of the mate electrical connector, and the extended strip-shaped portions each extending to be bent from the end portion of the strip-shaped portion so as to have the free end portion. When the electrical cable connector accompanied with the cables each connected with the cable connecting portion of a corresponding one of conductive contacts arranged on the insulating housing is coupled with the mate electrical connector mounted on the parts-mounting surface of the circuit board, the insulating housing is fitted to the mate insulating housing of the mate electrical connector and the contact-connecting portion of each of the conductive contacts is put in contact with the corresponding one of mate conductive contacts arranged on the mate insulating housing of the mate electrical connector. Thereby, the cables connected respectively with the conductive contacts of the electrical cable connector are electrically linked, through the electrical cable connector and the mate electrical connector, with the circuit board on which the mate electrical connector is mounted.

Under a condition wherein the electrical cable connector according to the present invention is coupled with the mate electrical connector in such a manner as described above, the strip-shaped portion of the resilient shell member extending around the insulating housing is operative to cause the inner surface portion thereof to come into resilient contact with the outer surface portion of the mate electrical connector and thereby the electrical cable connector is locked to the mate electrical connector. This results in that the electrical cable connector according to the present invention is properly and stably maintained in coupling with the mate electrical connector.

With the electrical cable connector according to the present invention, when the electrical cable connector is coupled with the mate electrical connector, the strip-shaped portion of the resilient shell member linked with the concealing portion of the resilient shell member to extend around the insulating housing is operative to cause the inner surface portion thereof to come into resilient contact with the outer surface portion of the mate electrical connector so as to cause the electrical cable connector to be locked to the mate electrical connector. On that occasion, since the strip-shaped portion of the resilient shell member and the extended strip-shaped portions of the resilient shell member each extending to be bent from the end portion of the strip-shaped portion so as to have the free end portion constitute the spring member and the holding portion extending from the concealing portion of the resilient shell member are operative to position the spring member from the outside of the same, a resilient pressing force by the spring member constituted with the strip-shaped portion and the extended strip-shaped portions, acts on the strip-shaped portion so that the inner surface of the strip-shaped portion is caused to contact resiliently with the outer surface portion of the mate electrical connector. In such a situation, the extended strip-shaped portions, each of which elongates to be bent from the end portion of the strip-shaped portion so as to have the free end portion, are operative to enhance the resilient pressing force by the spring member acting on the strip-shaped portion.

In the electrical cable connector according to the present invention which is provided with the resilient shell member thus constituted, the resilient shell member is able to keep sufficient resiliency even under the situation wherein the resilient shell member is reduced in its size in a direction perpendicular to the parts-mounting surface of the circuit board along with a reduction in thickness of the electrical cable connector as a whole for achieving low-profile, and in addition, is less susceptible to changes with time. Therefore, with the electrical cable connector according to the present invention, the strip- shaped portion of the resilient shell member, on which the resilient pressing force by the spring member constituted with the strip-shaped portion and the extended strip-shaped portions is caused to act, is able to cause surely and stably the inner surface portion thereof to come into resilient contact with the outer surface portion of the mate electrical connector even under the situation wherein the electrical cable connector as a whole is subjected to reduction in its thickness for achieving low- profile, so that the electrical cable connector is maintained properly and surely in coupling with the mate electrical connector.

The above, and other objects, features and advantages of the present invention will become apparent from the following detailed description taken in conjunction with the accompanying drawings.

DETAILED DESCRIPTION OF THE INVENTION

Figure 1:
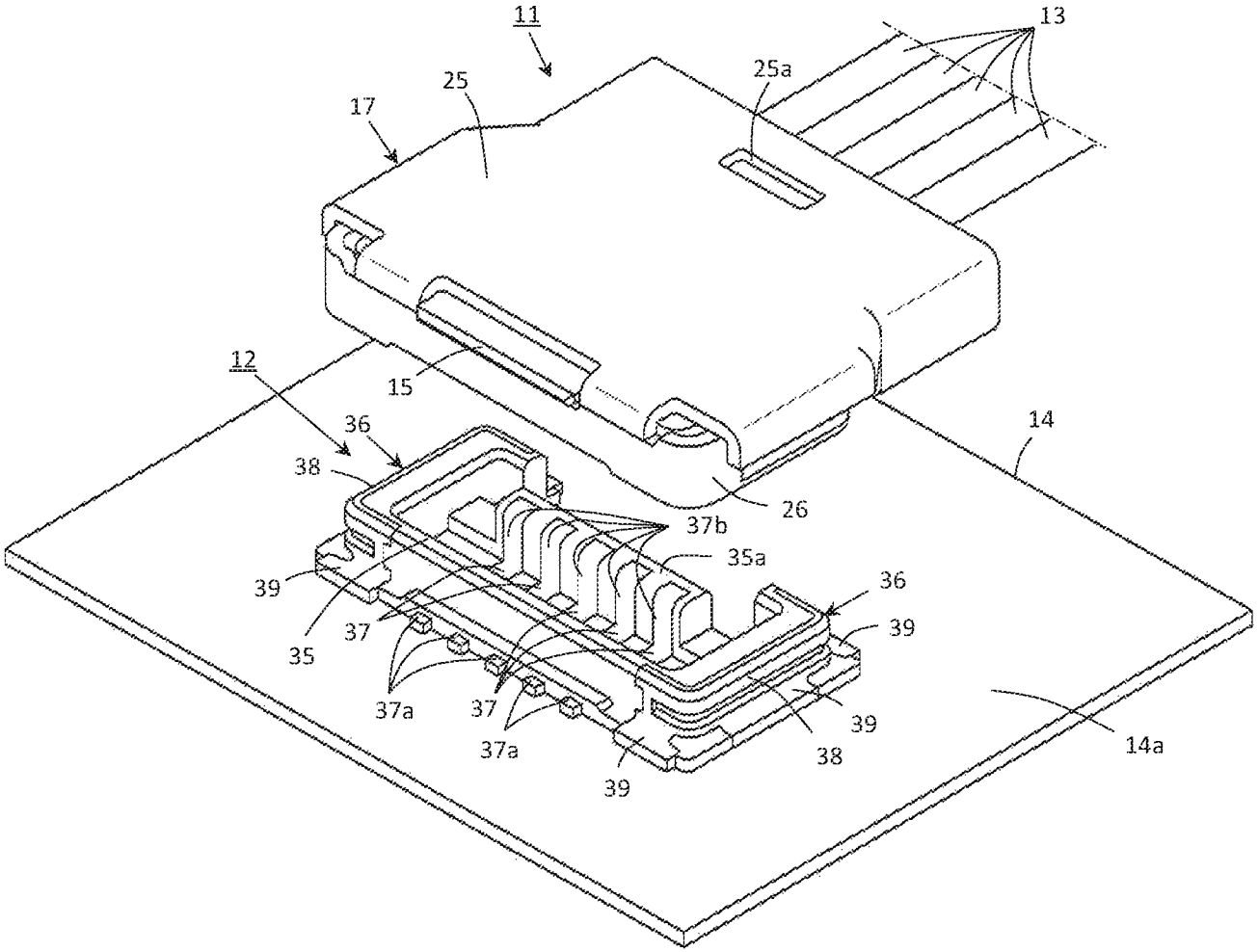
FIG. 1 is a schematic perspective view showing an embodiment of electrical cable connector according to the present invention which constitutes a plug connector, together with a plurality of coaxial cables connected with the plug connector, and a mating electrical connector which constitutes a receptacle connector and with which the plug connector is to be coupled, together with a circuit board on which the receptacle connector is mounted.

FIG. 1 shows a plug connector 11 which is constituted with an embodiment of electrical cable connector according to the present invention and accompanied with a plurality of relatively thin coaxial cables 13 connected thereto, and a receptacle connector 12 which is constituted with a mating electrical connector mounted on a circuit board 14 and with which the plug connector 11 is to be coupled. The receptacle connector 12 is fixed to a parts-mounting surface 14*a* of the circuit board 14, which faces upward in FIG. 1.

Figure 2:
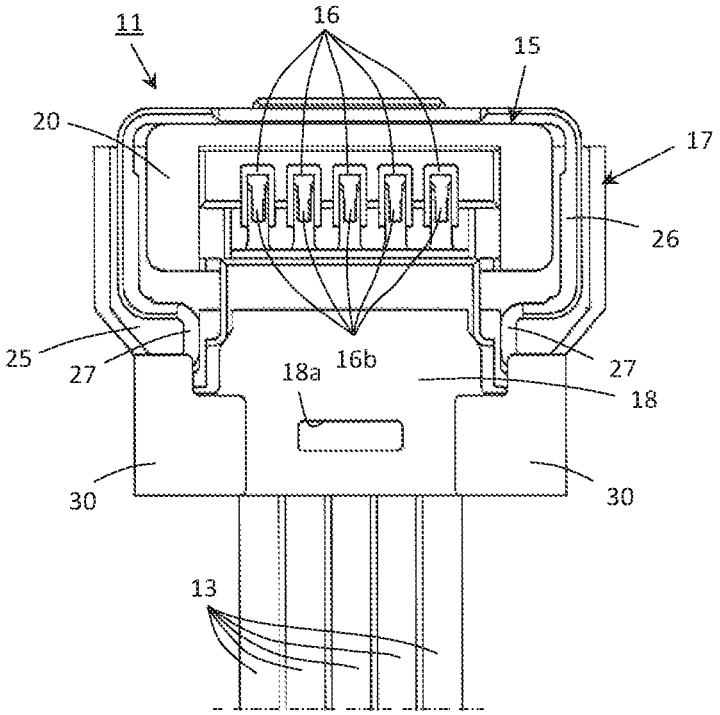
FIG. 2 is a schematic bottom view showing the plug connector accompanied with the coaxial cables as shown in FIG. 1.

The plug connector 11, that is, the embodiment of electrical cable connector according to the present invention, comprises an insulating housing 15 made of insulator such as plastics or the like, a plurality of conductive contacts 16 arranged on the insulating housing 15 and a resilient shell member 17 attached to the insulating housing 15, as shown also in FIG. 2. The insulating housing 15 is provided with an inner shell member 18 which is made of metal plate material and integrated with the insulating housing 15 by means of insert molding so as to reinforce the insulating housing 15. Each of the conductive contacts 16 is made of resilient conductive plate material to be shaped into a strip. The resilient shell member 17 is made of resilient conductive plate material subjected to bending processing.

Figure 3:
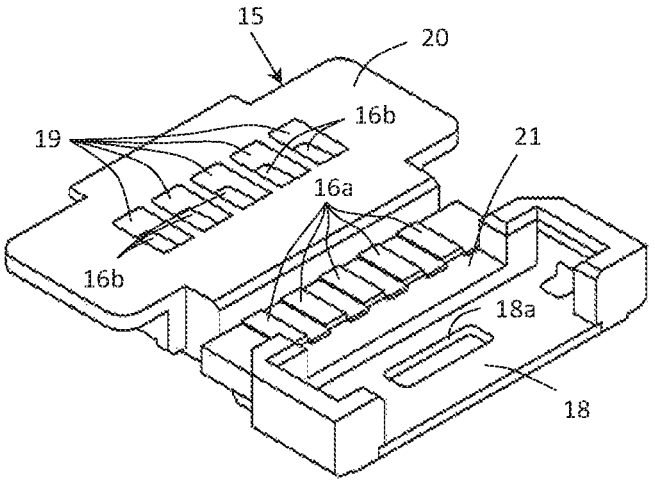
FIG. 3 is a schematic perspective view showing an insulating housing employed in the plug connector shown in FIG. 1, together with an inner shell member and a plurality of conductive contacts arranged on the insulating housing.

As shown in FIG. 3, the insulating housing 15 accompanied with the inner shell member 18 has a top board portion 20 on which a plurality of through-holes 19 are arranged and a cable supporting portion 21 which is reinforced with the inner shell member 18. Each of the conductive contacts 16 arranged on the insulating housing 15 is provided with a cable connecting portion 16*a* to be connected with a core conductor 13*a* (shown in FIG. 4 explained later) of the coaxial cable 13 and a contact-connecting portion 16*b* operative to be put in contact with a mate conductive contact 37 (shown in FIG. 10 explained later) provided on the receptacle connector 12 fixed to the parts-mounting surface 14*a* of the circuit board 14, and integrated with the insulating housing 15 to be partially buried therein by means of insert molding. The cable connecting portion 16*a* of each of the conductive contacts 16 is exposed outward on the cable supporting portion 21 of the insulating housing 15 and the contact-connecting portion 16*b* of each of the conductive contacts 16 is put in the through-hole 19 on the top board portion 20 of the insulating housing 15.

Figure 4:
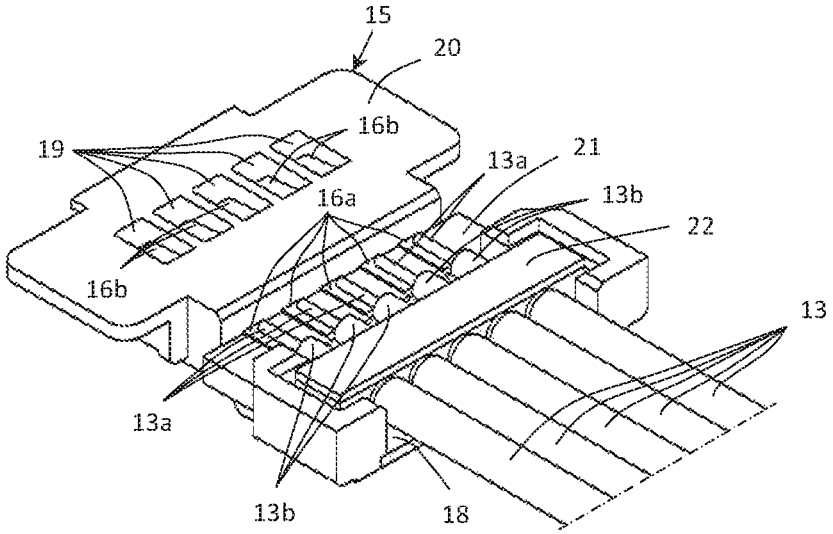
FIG. 4 is a schematic perspective view showing a condition wherein the coaxial cables shown in FIG. 1 are connected respectively with the conductive contacts shown in FIG. 3 and outer conductors which the coaxial cables have respectively are linked with a ground bar member.
Figure 5:
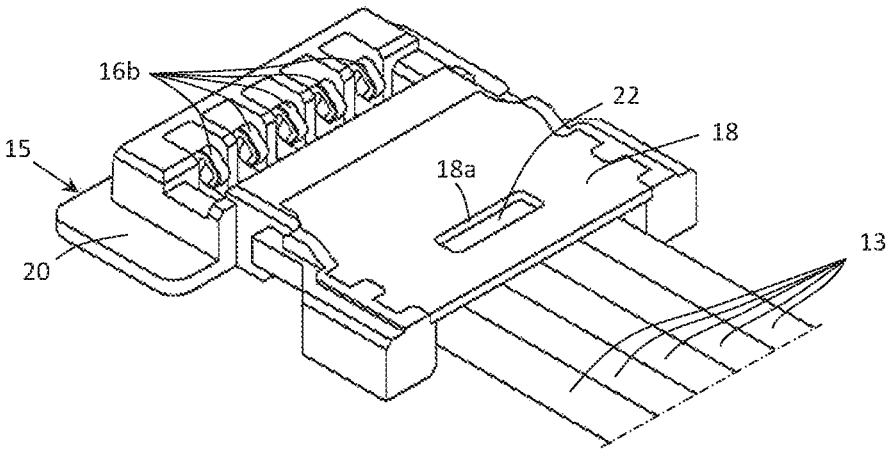
FIG. 5 is a schematic bottom view showing the condition wherein the coaxial cables shown in FIG. 1 are connected respectively with the conductive contacts which are arranged on the insulating housing together with the inner shell member.

As shown in FIGS. 4 and 5, the coaxial cables 13, each of which has an end portion at which the core conductor 13*a* and an outer conductor 13*b* are exposed, are put on the insulating housing 15 accompanied with the inner shell member 18 as shown in FIG. 3 in such a manner that the core conductor 13*a* of each of the coaxial cables 13 is positioned on the cable connecting portion 16*a* of a corresponding one of the conductive contacts 16 exposed outward at the cable supporting portion 21 of the insulating housing 15 and the outer conductor 13*b* of each of the coaxial cables 13 is positioned on the inner shell member 18 reinforcing the cable supporting portion 21 of the insulating housing 15. Then, the core conductor 13*a* of each of the coaxial cables 13 is connected with the cable connecting portion 16*a* of the corresponding one of the conductive contacts 16 by means of, for example, soldering and the outer conductor 13*b* of each of the coaxial cable 13 is put between a pair of ground bar members 22 facing each other so that the outer conductors 13*b* provided respectively in the coaxial cables 13 are linked with the ground bar members 22. A portion of the inner shell member 18 is soldered to the one of the ground bar members 22 facing each other through a through-holes 18*a* formed on the inner shell member 18.

Figure 6:
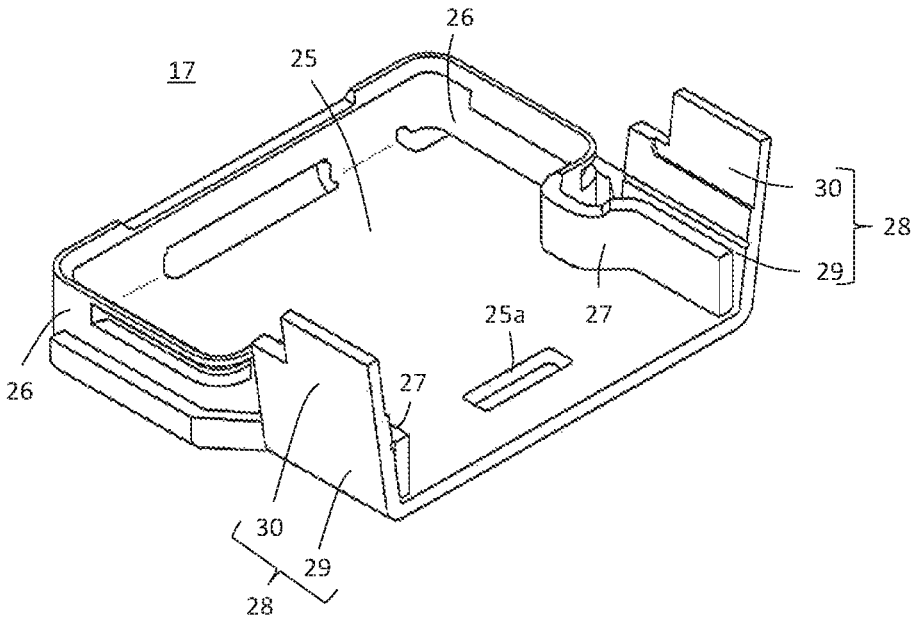
FIG. 6 is a schematic perspective view showing a resilient she member employed in the plug connector shown in FIG. 1.

As shown also in FIG. 6, the resilient shell member 17 attached to the insulating housing 15 of the plug connector 11 shown in FIG. 1 includes a concealing portion 25 for concealing a portion of the insulating housing 15 on which the conductive contacts 16 are arranged, a strip-shaped portion 26 linked with the concealing portion 25 to extend around the insulating housing 15, and a pair of extended strip-shaped portions 27 each extending to be bent from one of end portions of the strip-shaped portion 26 so as to have a free end portion. The strip- shaped portion 26 and the extended strip-shaped portions 27 constitute a spring member. A pair of holding portions 28, each of which extends from the concealing portion 25, are provided for positioning respectively the extended strip-shaped portions 27 from the outside thereof. Each of the holding portions 28 extending from the concealing portion 25 has a constraining portion 29 extending along an outer surface of the extended strip-shaped portion 27 from the concealing portion 25 and a covering portion 30 elongating to be bent from the constraining portion 29 for covering the extended strip-shaped portions 27. Under such a condition, the strip-shaped portion 26 of the resilient shell member 17 is operative to cause an inner surface portion thereof to come into resilient contact with an outer surface portion of the receptacle connector 12 when the plug connector 11 is coupled with the receptacle connector 12.

The resilient shell member 17 constitutes a single member with the strip-shaped portion 26 surrounding partially the insulating housing 15. The end portions of the strip-shaped portion 26 face each other with a predetermined space therebetween and the extended strip-shaped portions 27 extend to be bent respectively from the end portions of the strip-shaped portion 26 so as to be opposite to each other. The holding portions 28 corresponding respectively to the extended strip-shaped portions 27 extend from the concealing portion 25 so as to be opposite to each other. However, it is not necessary for the resilient shell member 17 to be limited to such an example as shown in FIGS. 1 and 6. For example, it is also possible that the resilient shell member 17 constitutes first and second shell components attached to the insulating housing 15 and each of the first and second shell components is provided with a part of the strip-shaped portion 26 and the extended strip-shaped portion 27. In such a case, the part of the strip-shaped portion 26 of the first shell component and the part of the strip-shaped portion 26 of the second shell component face each other with the insulating housing 15 therebetween, the extended strip-shaped portion 27 of the first shell component and the extended strip-shaped portion 27 of the second shell component are opposite to each other with a predetermined space therebetween so as to cause the free end portions provided respectively on the extended strip- shaped portions 27 to be opposite to each other, and each of the extended strip-shaped portions 27 is positioned from the outside thereof with the holding portion 28 extending from the concealing portion 25.

Figure 7:
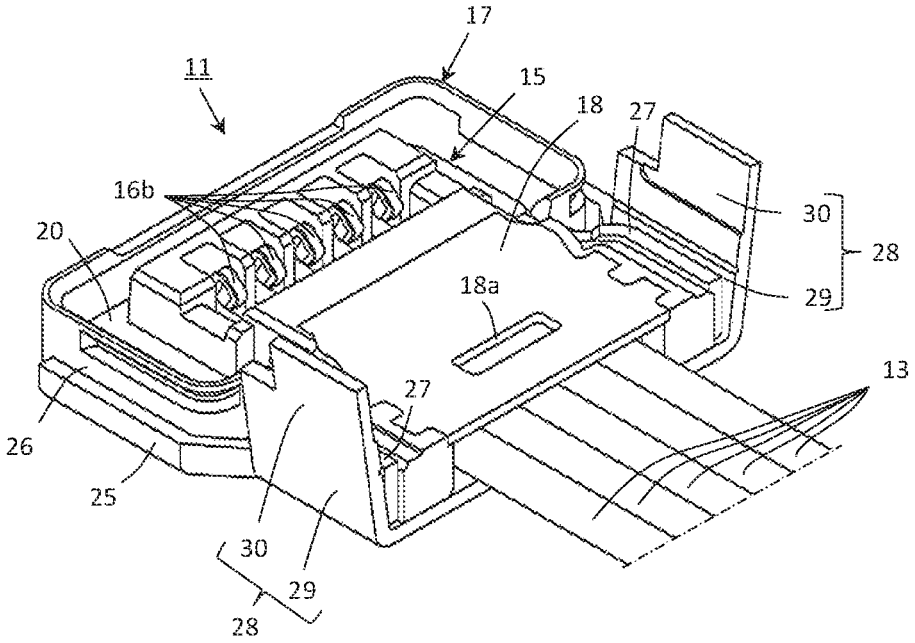
FIG. 7 is a schematic perspective view showing a condition wherein the resilient shell member shown in FIG. 6 is attached to the insulating housing on which the inner shell member and the conductive contacts with which the coaxial cables are connected respectively are arranged as shown in FIG. 5.
Figure 8:
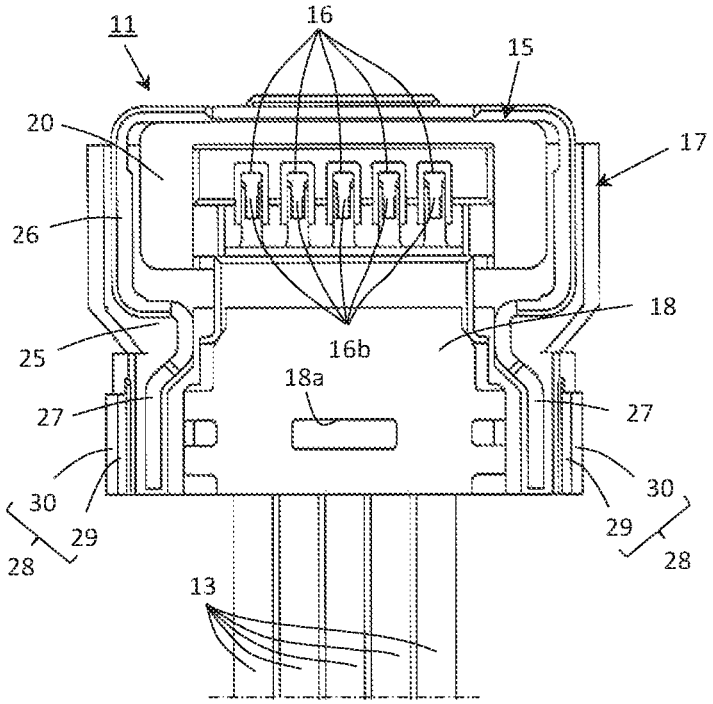
FIG. 8 is a schematic bottom view showing the condition wherein the resilient shell member shown in FIG. 6 is attached to the insulating housing on which the inner shell member and the conductive contacts with which the coaxial cables are connected respectively are arranged as shown in FIG. 5.

As shown in FIGS. 7 and 8, the resilient shell member 17 shown in FIG. 6 is caused to be attached to the insulating housing 15 which is provided with the inner shell member 18 shown as shown in FIG. 5 and on which the conductive contacts 16 with which the coaxial cables 13 are connected respectively are arranged. On that occasion, the concealing portion 25 of the resilient shell member 17 covers the top board portion 20 of the insulating housing 15 on the conductive contacts 16 are arranged and the cable supporting portion 21 of the insulating housing 15, the strip-shaped portion 26 linked with the concealing portion 25 surrounds partially the top board portion 20 of the insulating housing 15, and the extended strip-shaped portions 27 elongating respectively from the end portions of the strip-shaped portion 26 are opposite to each other with the cable supporting portion 21 of the insulating housing 15 therebetween, In such a condition, the cable connecting portion 16*a* of each of the conductive contacts 16 exposed outward at the cable supporting portion 21 of the insulating housing 15 is positioned in the space between the extended strip-shaped portions 27 of the resilient shell member 17 opposite to each other.

Figure 9:
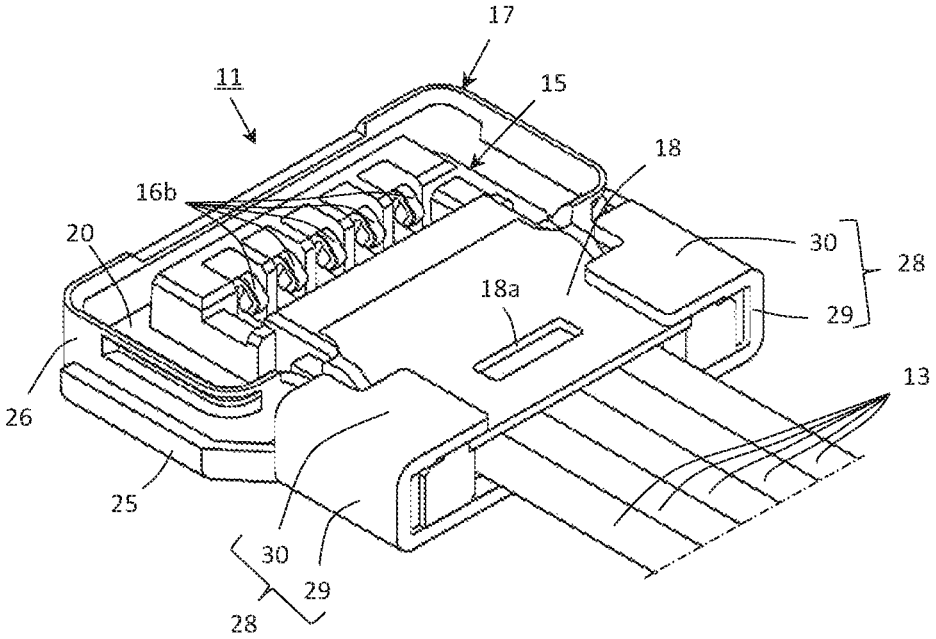
FIG. 9 is a schematic perspective view showing a condition wherein a pair of holding portions of the resilient shell member shown in FIG. 7 are folded down.

After the resilient shell member 17 is attached to the insulating housing 15 which is provided with the inner shell member 18 and on which the conductive contacts 16 with which the coaxial cables 13 are connected respectively are arranged, as shown in FIGS. 7 and 8, each of the covering portions 30 constituting respectively the holding portions 28 each extending from the concealing portion 25 of the resilient shell member 17 is bent inward, so that each of the extended strip-shaped portions 27 of the resilient shell member 17 is positioned from the outside thereof with the constraining portion 29 constituting the holding portion 28 and covered with the covering portion 30 constituting the holding portions 28, as shown in FIG. 9. Thereby, each of the extended strip-shaped portions 27 is properly and surely positioned with the holding portion 28 including the constraining portion 29 and the covering portion 30. Further, the concealing portion 25 of the resilient shell member 17 is soldered to the other of the ground bar members 22, which are facing each other with the outer conductors 13*b* provided respectively in the coaxial cables 13 therebetween, through a through-hole 25*a* formed on the concealing portion 25. As a result, the plug connector 11 with which the coaxial cables 13 are connected as shown in FIG. 1 is obtained.

Figure 10:
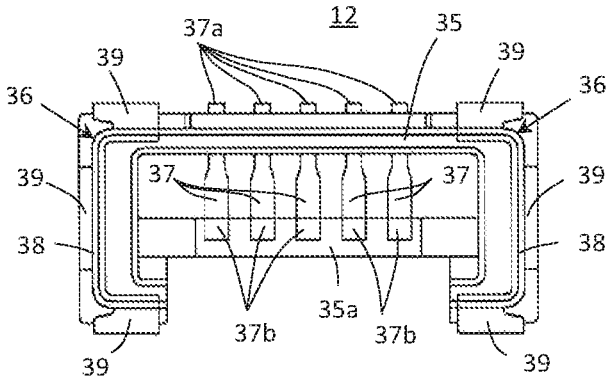
FIG. 10 is a schematic plan view showing the receptacle connector shown in FIG. 1.

The receptacle connector 12, which is constituted with the mate electrical connector and with which the plug connector 11 is to be coupled, is provided with a mate insulating housing 35 made of insulator such as plastics or the like and a pair of holding metal members 36 fixed to the mate insulating housing 35 by means of, for example, insert molding, as shown also in FIG. 10.

The mate insulating housing 35 has a protrusion 35*a* which comes into the plug connector 11 when the plug connector 11 is coupled with the receptacle connector 12. A plurality of mate conductive contacts 37 are arranged on the mate insulating housing 35. Each of the mate conductive contacts 37 is made of resilient conductive plate material to be shaped into a strip and provided, respectively at both end portions of the stripe, with a board connecting portion 37*a* to be connected with a circuit terminal provided on the parts-mounting surface 14*a* of the circuit board 14 and a contact-connecting portion 37*b* operative to be put in contact with the contact-connecting portion 16*b* of the conductive contact 16 provided on the plug connector 11 with which the coaxial cables 13 are connected. The board connecting portions 37*a* provided respectively on the mate conductive contacts 37 are arranged to project from the mate insulating housing 35 to the outside of the mate insulating housing 35 so as to be connected respectively with the circuit terminals provided on the parts-mounting surface 14*a* of the circuit board 14 by means of, for example, soldering. The contact-connecting portions 37*b* provided respectively on the mate conductive contacts 37 are arranged along an inside wall surface and a top surface of the protrusion 35*a* provided on the mate insulating housing 35.

The holding metal members 36 are placed to be opposite to each other with the mate insulating housing 35 therebetween in a direction along which the mate conductive contacts 37 are arranged on the mate insulating housing 35. Each of the holding metal members 36 has a body portion 38 extending along the mate insulating housing 35 and a plurality of fixing portions 39 each projecting from the body portion 38 to be fixed to the parts-mounting surface 14*a* of the circuit board 14. When the plug connector 11 is coupled with the receptacle connector 12, the strip-shaped portion 26 of the resilient shell member 17 provided on the plug connector 11 causes the inner surface portion thereof to come into contact with an outer surface portion of the body portion 38. Each of the fixing portions 39 is fixed to the parts-mounting surface 14*a* of the circuit board 14 by means of, for example, soldering and thereby the receptacle connector 12 is fixed to the parts-mounting surface 14*a* of the circuit board 14.

Under such a condition, the plug connector 11 which is constituted with the embodiment of circuit board connecting device according to the present invention is caused to be coupled with the receptacle connector 12 which is constituted with the mating connecting device.

Figure 11:
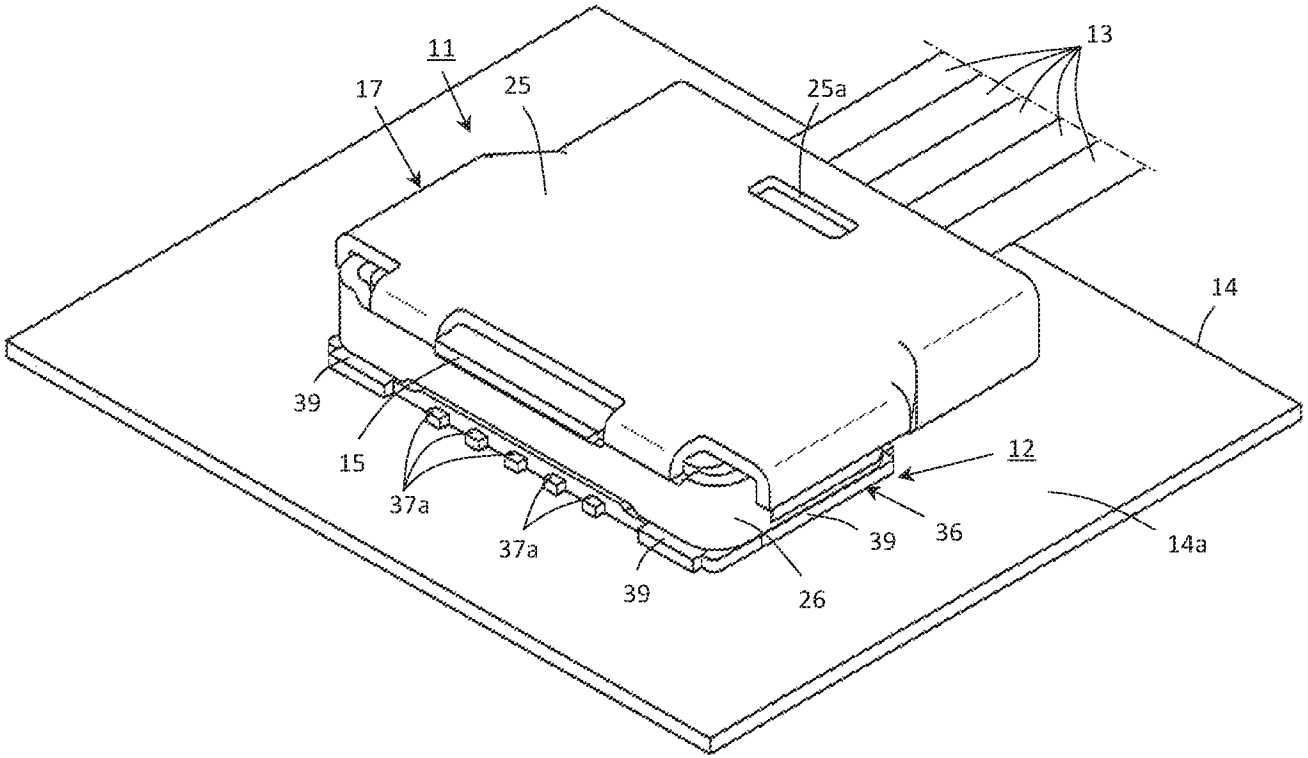
FIG. 11 is a schematic perspective view showing a condition wherein the plug connector accompanied with the coaxial cables as shown in FIG. 1 is coupled with the receptacle connector mounted on the circuit board as shown in FIG. 1.
Figure 12:
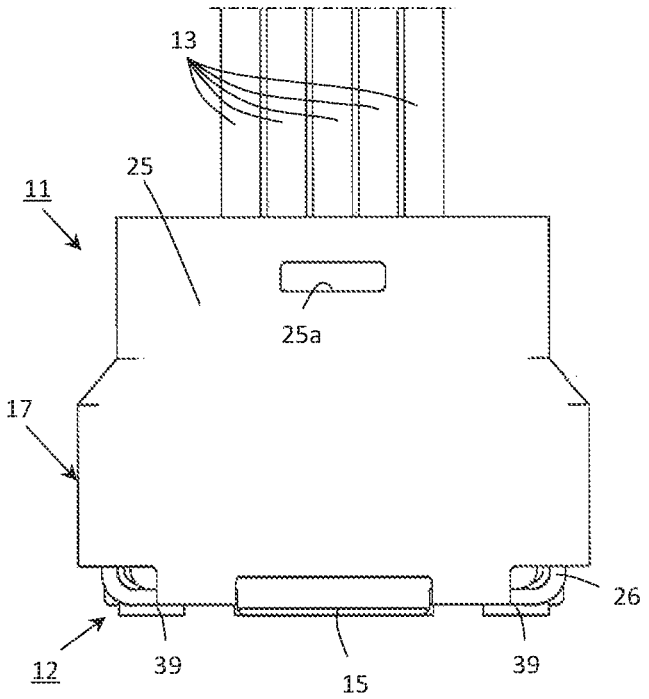
FIG. 12 is a schematic plan view showing a condition wherein the plug connector accompanied with the coaxial cables as shown in FIG. 1 is coupled with the receptacle connector shown in FIG. 1.
Figure 13:
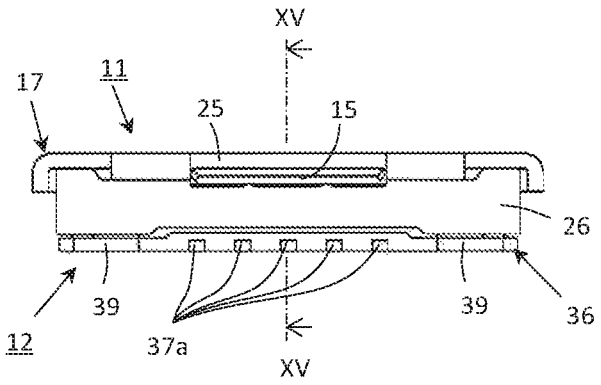
FIG. 13 is a schematic side view showing the condition wherein the plug connector accompanied with the coaxial cables as shown in FIG. 1 is coupled with the receptacle connector shown in FIG. 1.
Figure 14:
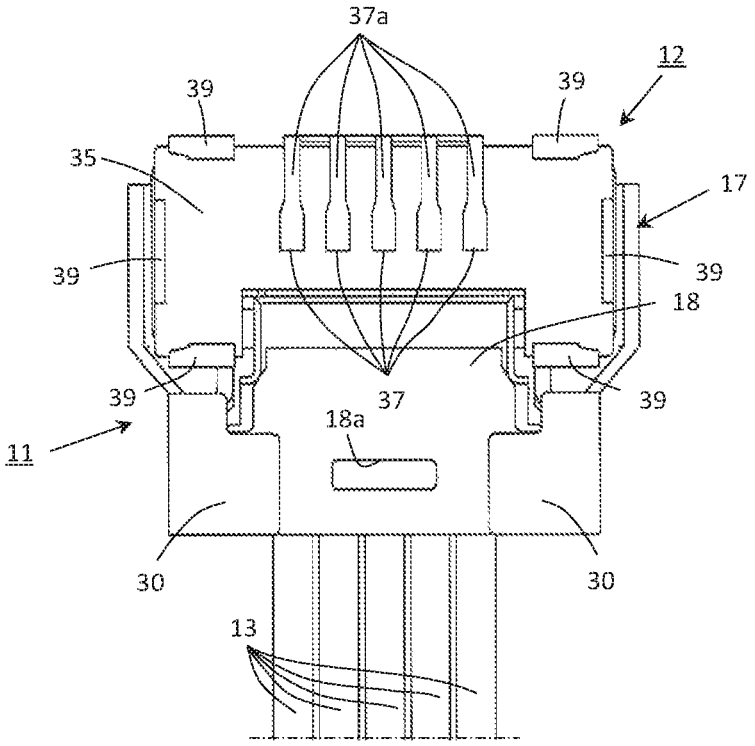
FIG. 14 is a schematic bottom view showing the condition wherein the plug connector accompanied with the coaxial cables as shown in FIG. 1 is coupled with the receptacle connector shown in FIG. 1.

On that occasion, under a situation wherein the coaxial cables 13 are connected with the plug connector 11, the insulating housing 15 of the plug connector 11 is fitted to the mate insulating housing 35 of the receptacle connector 12 in such a manner that the protrusion 35*a* provided on the mate insulating housing 35 of the receptacle connector 12 is inserted into the inside of the insulating housing 15 of the plug connector 11. As a result, the plug connector 11 accompanied with the coaxial cables 13 is put in connecting-coupling with the receptacle connector 12 accompanied with the circuit board 14, as shown in FIG. 11 (the schematic perspective view showing), FIG. 12 (the schematic plan view in which the circuit board 14 is omitted to be shown), FIG. 13 (the schematic side view in which the circuit board 14 are omitted to be shown), FIG. 14 (the schematic bottom view in which the circuit board 14 is omitted to be shown), and FIG. 15 (the schematic cross-sectional view taken along line XV-XV in FIG. 13).

Figure 15:
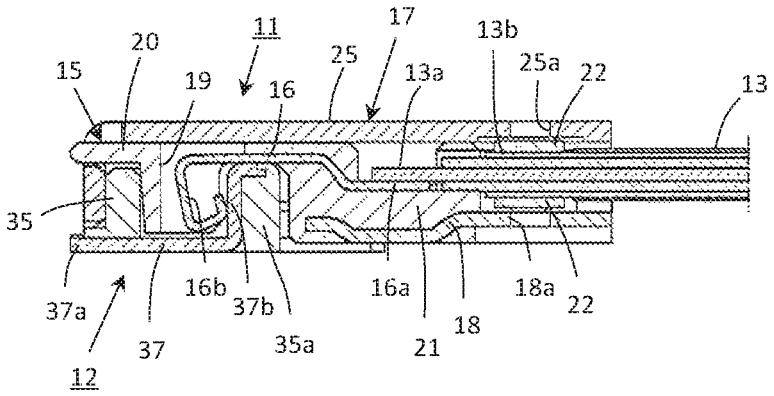
FIG. 15 is a schematic cross-sectional view taken along line XV-XV in FIG. 13.

Under a condition wherein the plug connector 11 is put in connecting-coupling with the receptacle connector 12, as shown in FIG. 15, the contact-connecting portions 16*b* of each of the conductive contacts 16 arranged on the insulating housing 15 of the plug connector 11 is caused to come into contact with the contact-connecting portion 37*b* of a corresponding one of the mate conductive contacts 37 arranged along the inside wall surface and the top surface of the protrusion 35*a* provided on the mate insulating housing 35 of the receptacle connector 12 so that the conductive contacts 16 of the plug connector 11 are contact-connected respectively with the mate conductive contacts 37 of the receptacle connector 12. As a result, the core conductor 13*a* of each of the coaxial cables 13 connected respectively with the cable connecting portions 16*a* of the conductive contacts 16 is linked, through the conductive contact 16 and the mate conductive contact 37, to a corresponding one of the circuit terminals provided on the parts-mounting surface 14*a* of the circuit board 14 with which the board connecting portions 37*a* of the mate conductive contacts 37 are connected respectively, so that the coaxial cables 13 are put in a condition of electrical connection with the circuit board 14.

Further, when the plug connector 11 is put in connecting-coupling with the receptacle connector 12, the strip-shaped portion 26 of the resilient shell member 17 provided on the plug connector 11, which extends to surround partially the insulating housing 15, is operative to cause the inner surface portion thereof to come into resilient contact with the outer surface portion of the body portion 38 of the holding metal member 36 provided on the receptacle connector 12 so as to cause the plug connector 11 to be locked to the receptacle connector 12, as shown in FIGS. 11 to 14. Under such a condition, since the strip-shaped portion 26 and the extended strip-shaped portion 27 of the resilient shell member 17 provided on the plug connector 11 constitute the spring member and each of the extended strip-shaped portions 27 of the resilient shell member 17 is positioned from the outside thereof with the holding portion 28 extending from the concealing portion 25 of the resilient shell member 17, a resilient pressing force by the spring member constituted with the strip- shaped portion 26 and the extended strip-shaped portion 27 of the resilient shell member 17, acts on the strip-shaped portion 26 so that the inner surface of the strip-shaped portion 26 is caused to contact resiliently with the outer surface portion of the body portion 38 of the holding metal member 36 provided on the receptacle connector 12. On that occasion, the extended strip-shaped portion 27 which elongates to be bent from the end portion of the strip-shaped portion 26 so as to have the free end portion and is positioned from the outside thereof with the holding portion 28 extending from the concealing portion 25, is operative to enhance the resilient pressing force by the spring member acting on the strip-shaped portion 26.

Accordingly, in the plug connector 11 provided with the resilient shell member 17, the strip-shaped portion 26 of the resilient shell member 17 is able to keep sufficient resiliency even under a situation wherein the resilient shell member 17 including the strip-shaped portion 26 is reduced in its size in a direction perpendicular to the parts-mounting surface 14*a* of the circuit board 14, to which the receptacle connector 12 is fixed, along with a reduction in thickness of the plug connector 11 as a whole for achieving low-profile, and in addition, is less susceptible to changes with time on the same. Therefore, with the plug connector 11, the strip-shaped portion 26 of the resilient shell member 17 on which the resilient pressing force by the spring member constituted with the strip- shaped portion 26 and the extended strip-shaped portion 27 of the resilient shell member 17 acts, is able to cause surely and stably the inner surface portion thereof to come into resilient contact with the outer surface portion of the body portion 38 of the holding metal member 36 provided on the receptacle connector 12 even under the situation wherein the plug connector 11 as a whole is subjected to reduction in its thickness for achieving low-profile, so that the plug connector 11 is maintained properly and surely in connecting-coupling with the receptacle connector 12.

The invention claimed is:

1. An electrical cable connector comprising;

an insulating housing provided to be fitted to a mate insulating housing of a mate electrical connector fixed to a parts-mounting surface of a circuit board, a plurality of conductive contacts arranged on the insulating housing, each of which is provided with a cable connecting portion to be connected with a cable and a contact-connecting portion operative to be put in contact with a corresponding one of mate conductive contacts arranged on the mate insulating housing of the mate electrical connector to be connected to the circuit board, and a resilient shell member attached to the insulating housing for engaging resiliently with the mate electrical connector when the electrical cable connector is coupled with the mate electrical connector, wherein the resilient shell member includes a concealing portion for concealing a portion of the insulating housing on which the conductive contacts are arranged, a strip-shaped portion linked with the concealing portion to surround partially the insulating housing for causing an inner surface portion thereof to come into resilient contact with an outer surface portion of the mate electrical connector, a pair of extended strip-shaped portions each extending to be bent from one of end portions of the strip-shaped portion so as to have a free end portion and a pair of holding portions each extending from the concealing portion for positioning the extended strip-shaped portion from the outside of the same, and the strip-shaped portion and the extended strip-shaped portions constitute a spring member, and the insulating housing accompanied with an inner shell member has a top board portion on which a plurality of openings in which contact-connecting portions of the plurality of conductive contacts are arranged respectively are arranged and a cable supporting portion which is reinforced with the inner shell member.

2. An electrical cable connector according to claim 1, wherein each of the holding portions has a constraining portion extending along an outer surface of the extended strip-shaped portion from the concealing portion and a covering portion elongating to be bent from the constraining portion for covering the extended strip-shaped portions.

3. An electrical cable connector according to claim 1, wherein the resilient shell member constitutes a single member with the strip-shaped portion which surrounds partially the insulating housing so that the end portions of the strip-shaped portion face each other with a predetermined space therebetween and the extended strip-shaped portions extend to be bent respectively from the end portions of the strip-shaped portion so as to be opposite to each other.

4. An electrical cable connector according to claim 3, wherein the cable connecting portion of each of the conductive contacts is exposed outward on the insulating housing in a space between the extended strip- shaped portions of the resilient shell member opposite to each other.

5. An electrical cable connector according to claim 1, wherein the resilient shell member constitutes first and second shell components attached to the insulating housing and each of the first and second shell components is provided with a part of the strip-shaped portion and the extended strip-shaped portion, so that the part of the strip-shaped portion of the first shell component and the part of the strip-shaped portion of the second shell component face each other with the insulating housing therebetween and the extended strip-shaped portion of the first shell component and the extended strip-shaped portion of the second shell component are opposite to each other with a predetermined space therebetween.

6. An electrical cable connector according to claim 5, wherein the extended strip-shaped portion of the first shell component and the extended strip-shaped portion of the second shell component are operative to cause the free end portions provided respectively on the extended strip-shaped portions to be opposite to each other.

* * * * *